United States Patent [19]

Ruger et al.

[11] Patent Number: 4,590,697

[45] Date of Patent: May 27, 1986

[54] AMBIDEXTROUS SAFETY MECHANISM

[75] Inventors: William B. Ruger, Croydon, N.H.; Roy L. Melcher, Stratford, Conn.

[73] Assignee: Sturm, Ruger & Company, Inc., Southport, Conn.

[21] Appl. No.: 624,188

[22] Filed: Jun. 25, 1984

[51] Int. Cl.[4] ..... F41C 17/04; F41C 17/00

[52] U.S. Cl. ..... 42/70 F; 42/70 R

[58] Field of Search ..... 42/70 R, 70 F

[56] References Cited

U.S. PATENT DOCUMENTS

| | | | |
|---|---|---|---|
| 3,633,303 | 1/1972 | Volkmar et al. | 42/70 F |
| 4,414,769 | 11/1983 | Mueschke | 42/70 R |
| 4,454,673 | 6/1984 | Meidel | 42/70 F |

*Primary Examiner*—Deborah L. Kyle
*Assistant Examiner*—Ted L. Parr
*Attorney, Agent, or Firm*—Pennie & Edmonds

[57] ABSTRACT

A two-position manual safety arrangement for an automatic pistol which pistol has a pivotal firing pin, a hammer blocking means, a trigger bar, a sear rotated by the pin blocking means and a configured slide. The safety arrangement includes a safety lever body rotatably mounted in the slide. The lever body carries first means to prevent the hammer from striking the firing pin in the first safety position and second means for preventing striking of the firing pin in the second safety position. The firing pin blocking means also blocks the firing pin in the second position.

3 Claims, 36 Drawing Figures

AMBIDEXTROUS SAFETY MECHANISM

BACKGROUND OF THE INVENTION

Numerous manual safety arrangements have been proposed for semi-automatic pistols which function to reduce the possibility that the gun will be discharged during carrying and handling except when the trigger is intentionally pulled.

Ambidextrous safety mechanisms have also been proposed but none has provided the protection of the scope of the present invention.

SUMMARY OF THE INVENTION

Broadly, the present invention comprises a semi-automatic pistol having a trigger, a trigger bar, a hammer, a firing pin having both a blocking surface and a lateral projection, a rotatable sear, a slide, a rotatable firing pin blocking piece normally blocking the firing pin through engagement with such blocking surface except when acted on by the trigger bar, and in addition having a manual safety having an inactive position and having an active position in which second active position the safety (1) blocks the hammer from engaging the firing pin (2) blocks forward movement of the firing pin through engagement with the firing pin lateral projection (3) rotates the sear to a position in which it cannot engage the hammer, and (4) holds the trigger bar down to prevent movement of the bar from rotating the rotatable firing pin blocking piece to unblock the firing pin.

It is also a feature that the safety is operable from either side of the gun and is readily disassembled.

DESCRIPTION OF THE PREFERRED EMBODIMENTS

Figure 1:
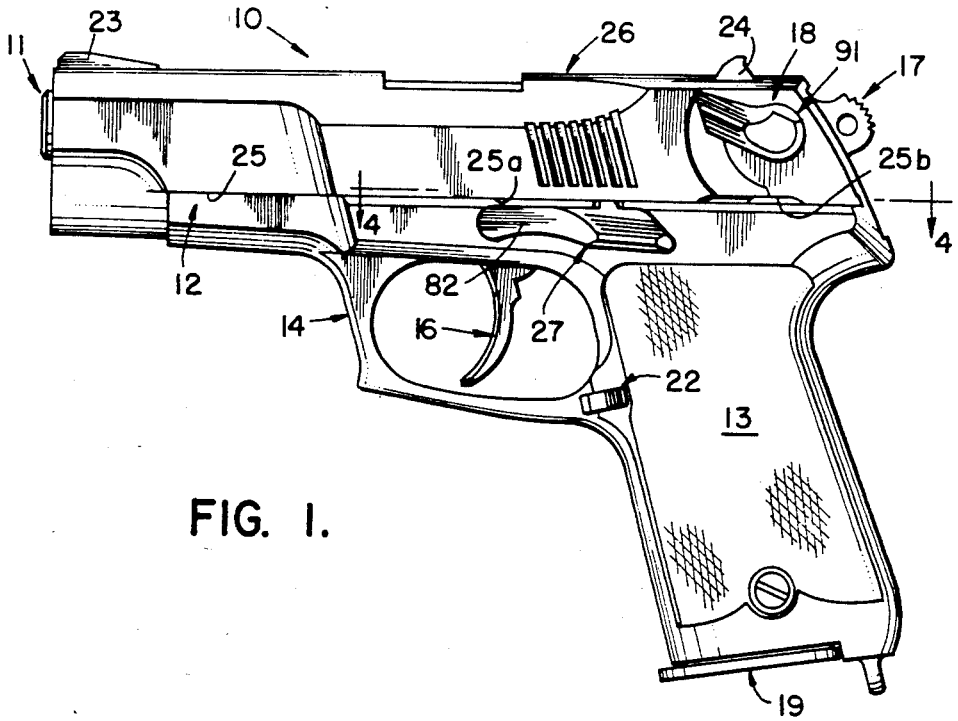
FIG. 1 is a side elevational view of a semi-automatic pistol embodying the invention.

In FIG. 1, semi-automatic pistol 10 includes barrel 11, frame 12, grip 13, trigger guard 14, trigger 16, hammer 17, manual safety lever 18, magazine 19, magazine release lever 22 and front and rear sights 23 and 24, respectively. Also shown is slide 26 and slide lock lever 27.

Figure 2:
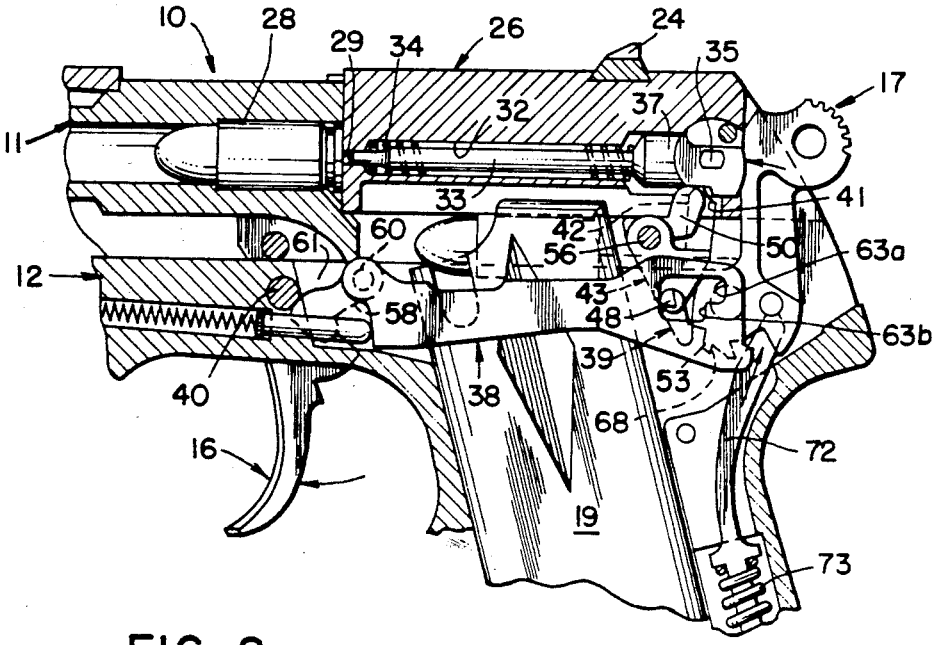
FIG. 2 is a partial sectional view through the centerline of the barrel and perpendicular to the trigger and hammer pivot.
Figure 3:
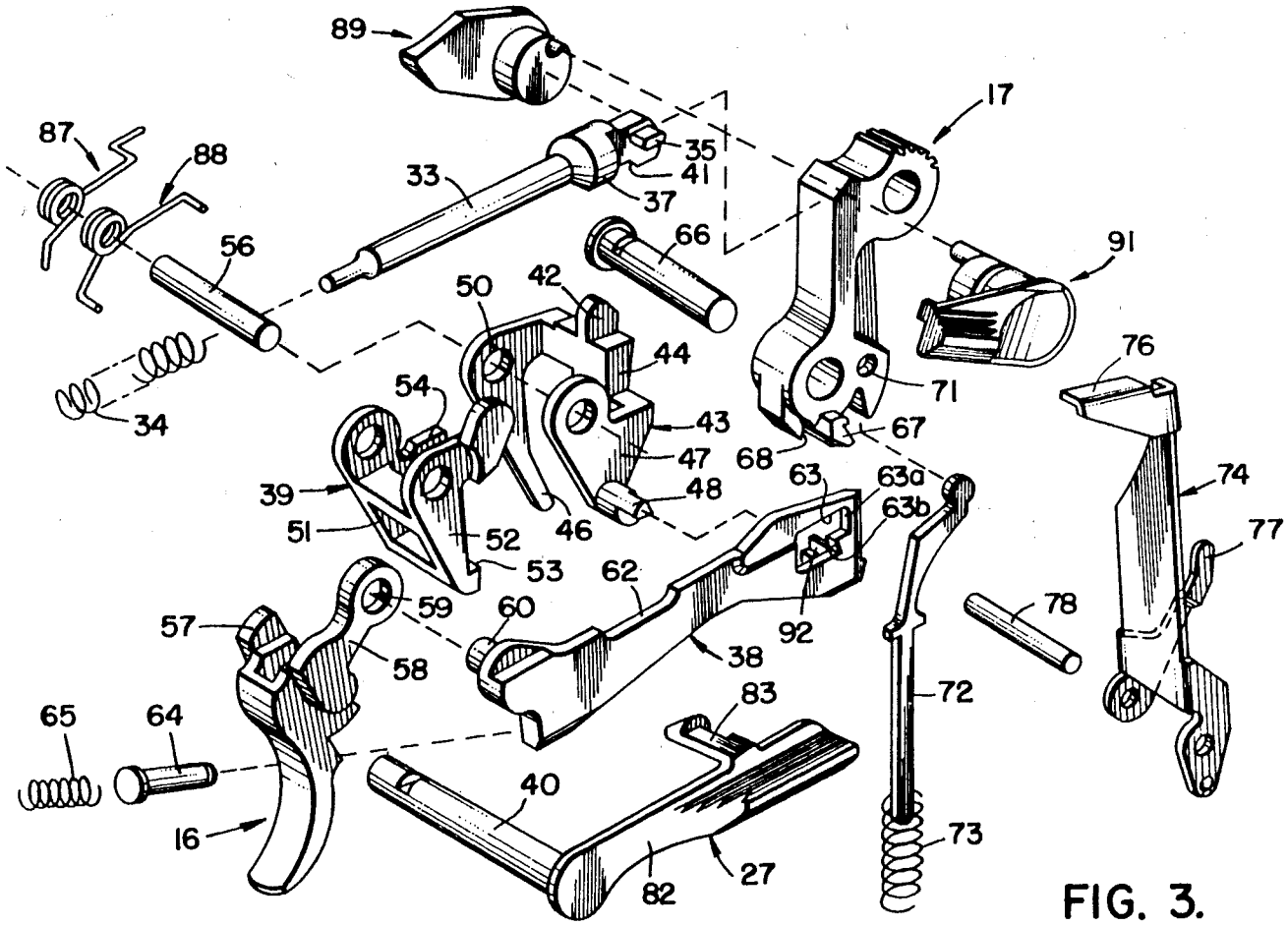
FIG. 3 is an exploded view of the rotatable firing pin block piece, sear and the related parts including the mechanism for controlling the blocking piece, sear and firing pin.

Turning to FIGS. 2 and 3, barrel 11 carries a cartridge 28 including primer 29, slide 26 with a firing pin housing cavity 32 and a firing pin 33 positioned therein.

Figure 28:
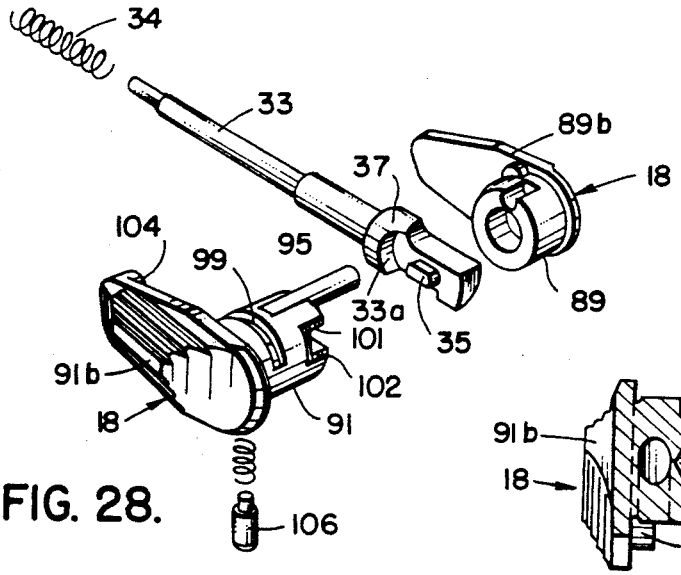
FIG. 28 is an exploded perspective view showing the right and left mechanism sections, connecting pin, and firing pin.

Firing pin 33 is normally urged to the rear by firing pin spring 34 which rearward movement of the firing pin 33 is limited by a firing pin surface 33*a* firing pin head portion 37 (see FIG. 28). Firing pin head portion 37 has formed thereon an angled stop surface 41 which engages projection finger 42 of pivotal firing pin blocking piece 43 to block firing pin 33. Also shown are trigger bar 38 and pivotal sear 39.

Firing pin blocking piece 43 includes center body 44 carrying upstanding blocking finger 42; depending ejector engageable leg 46 and spaced-apart depending support piece 47 which carries blocking piece stud 48.

Nested within the opening between the ejector leg 46 and support piece 47 of blocking piece 43 is pivotal sear 39. Sear 39 includes spaced-apart frame members 51, 52, sear, notch 53 and sear manual latch projection 50. Frame member 51 has an upper surface 54 which engages with body portion 44 of blocking piece 43 when the blocking piece 43 is rotated about its pivot pin 56. Sear 39 also rotates about the same pin 56.

Trigger 16 includes two (2) trigger pivot cams 57, 58. One cam 57 is on one side of trigger 16 and the other pivot cam with extension arm 58 is on the other side. Cam 58 includes opening 59 which carries trigger bar pivot stud 60 attached to (or forming a part of) trigger bar 38. Trigger 16 with its attached cams 57, 58 rotates in configured frame opening 61 and is restrained in part by latch axle 40 of latch 27.

Trigger bar 38 has upper configured cam surface 62 which rides against a lower interior surface 25 of slide 26 (FIG. 2). Interior slide surface 25 includes a straight portion 25*a* and a recessed portion 25*b*. Trigger bar 38 also includes trigger bar opening 63 which opening 63 includes a larger upper portion 63*a* and a smaller lower portion 63*b*. Trigger bar 38 is urged counterclockwise (FIG. 2) about pivot stud 60 by trigger bar plunger 64 urged by plunger spring 65. The travel and position of the trigger bar 38 during operation and handling of the pistol is determined by the position of trigger 16 and the position of reciprocal slide 26. The varying positions of these parts during pistol operation will be further described with reference to subsequent figures.

Hammer 17 is pivotal about hammer pivot 66. Hammer 17 includes side projection notch 67, sear notch 68 and hammer strut opening 71. Hammer strut 72 together with hammer strut spring 73 urge hammer 17 to its down position as shown in FIG. 2.

Cartridge ejector 74 includes cartridge engaging lip 76 and blocking piece engageable wing 77. Ejector 74 is pivotal about ejector pivot pin 78.

Also shown in FIG. 3 is slide lock lever 27 which includes slide lock axle 40, slide body portion 82; and catch 83. In addition sear return spring 87; blocking piece return spring 88; and manual safety sections 89 and 91 are shown. Trigger bar side extension 92 for engaging hammer projection 67 in double action operation is also shown.

Figure 4:
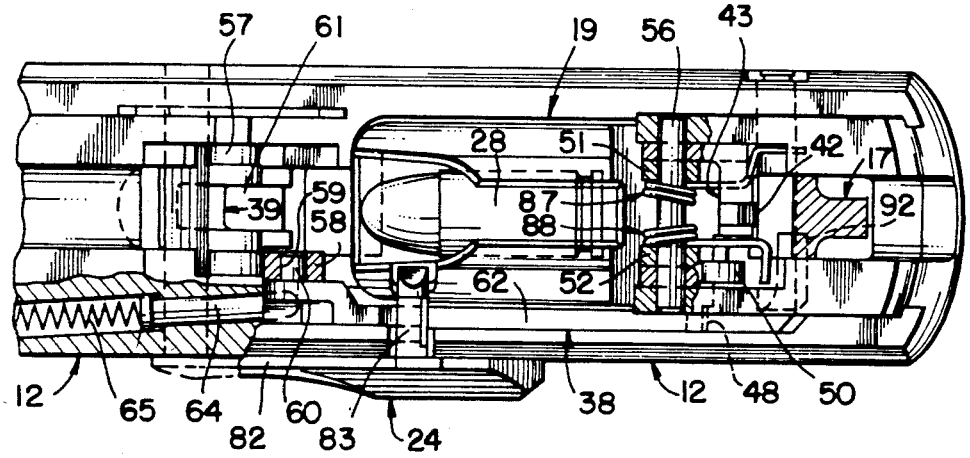
FIG. 4 is a partial plan view with the slide removed.
Figure 5:
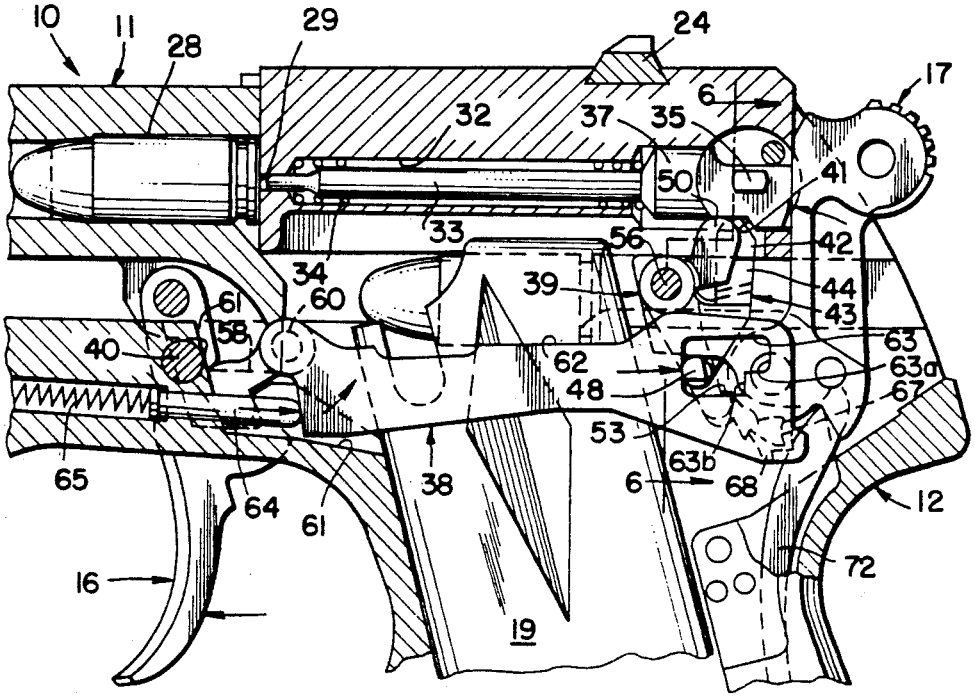
FIG. 5 is a partial enlarged view of FIG. 2 with the hammer down.

Turning now to FIGS. 4 and 5, the hammer 17 is shown down in its rest position with both firing pin blocking piece 43 and sear 39 rotated fully counterclockwise under urging of, and limited by, their return springs 87 and 88 (see FIG. 3). In this state, firing pin blocking piece 43 is in its blocking position with firing pin 33 constrained from being driven forward any substantial distance as its surface 41 will engage blocking piece projection finger 42 to block pin 33 from striking the primer 29 of cartridge 28.

Figure 6:
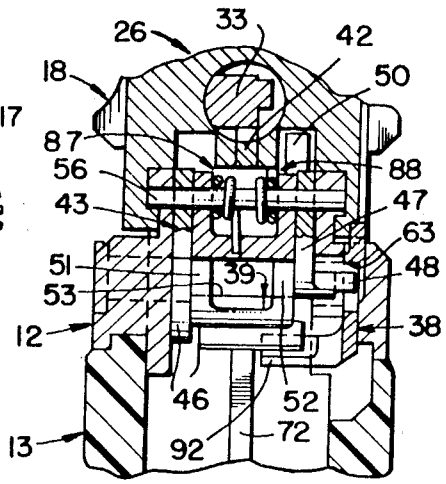
FIG. 6 is a section along line 6—6 of FIG. 5.
Figure 7:
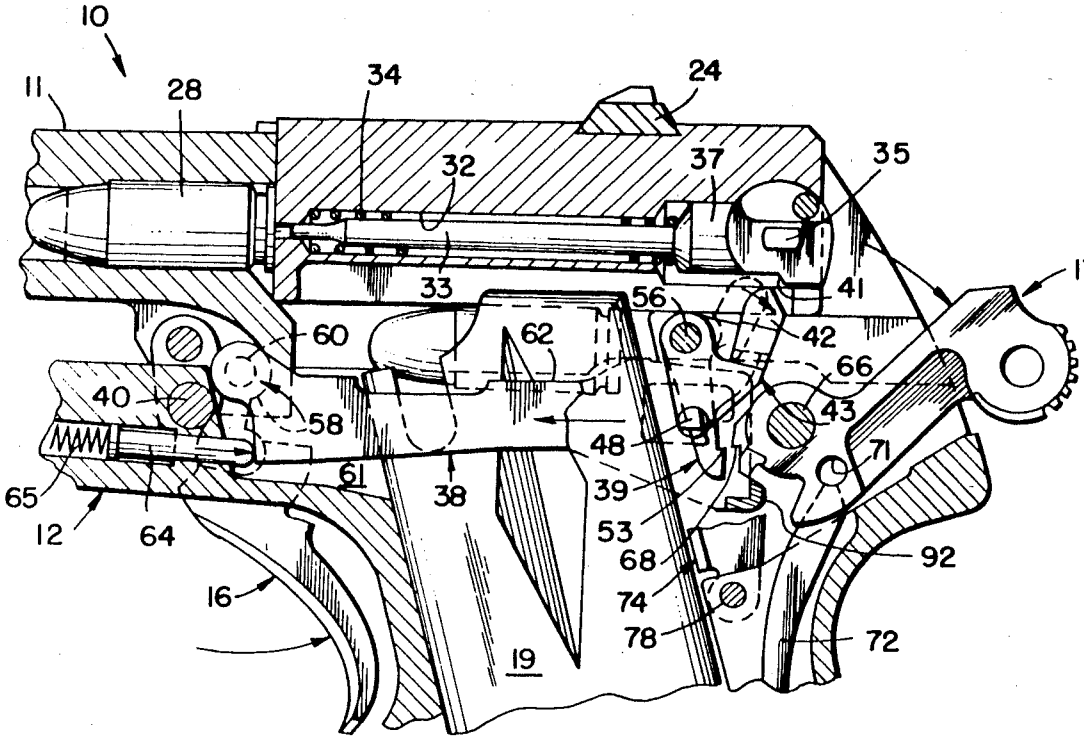
FIG. 7 is a partial enlarged view of FIG. 2 with the hammer fully rotated back by trigger pull.
Figure 8:
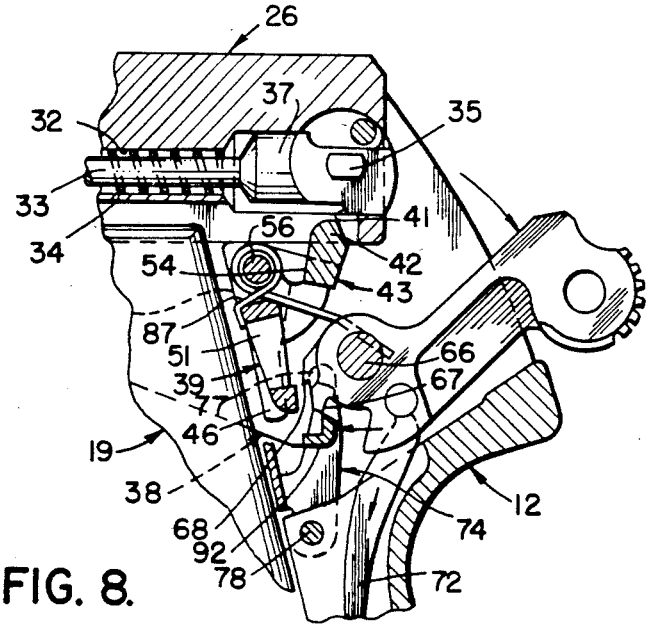
FIG. 8 is a partial enlarged view of FIG. 7.
Figure 9:
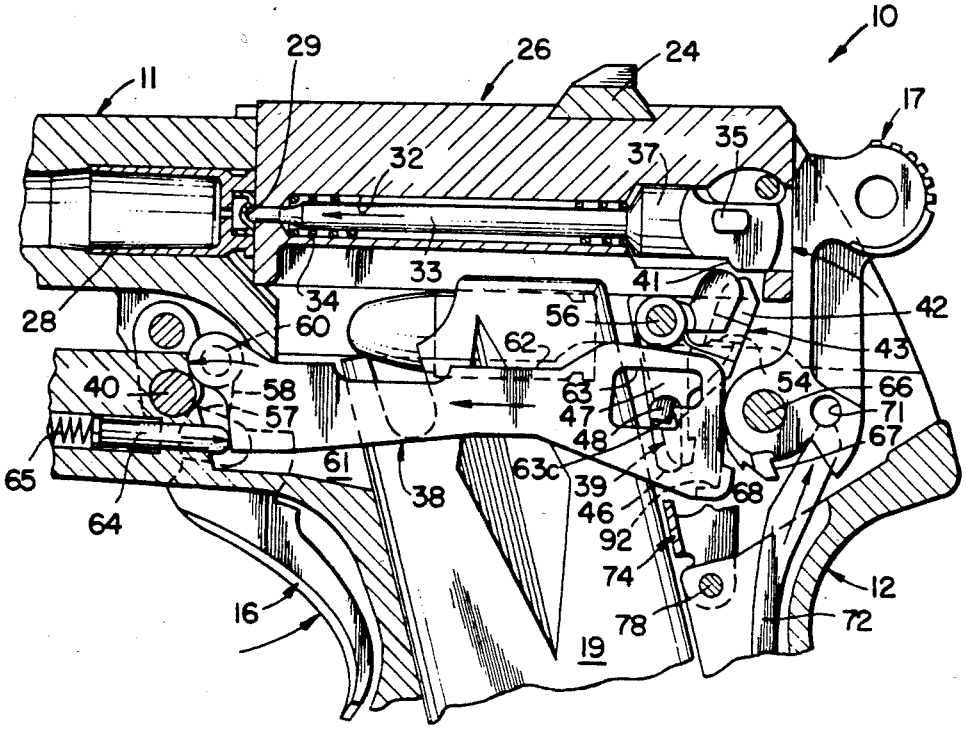
FIG. 9 is a side elevational sectional view showing the hammer down and trigger back.

Turning now to FIGS. 5–13, the following positions of the firing mechanism are shown:

(a) in FIGS. 5 and 6, the hammer 17 is down in its rest position with firing pin blocking piece 43 preventing firing pin 33 from engaging cartridge 38 should the pistol hammer 17 or other object strike the head 37 of the firing pin;

(b) in FIGS. 5, 7, 8 and 9, starting with the hammer down and operating in the double action mode, trigger 16 is pulled causing trigger bar 38 (and in particular its lateral extension 92) to move forward pulling hammer projection 67 to rotate hammer 17 back. As trigger pull continues, trigger bar 38 and its opening 63 move forward. Blocking piece stud 48 remains unengaged until surface 63*c* (the rearward surface of lower smaller opening area 63*b* of opening 63) is brought into contact with the stud 48 (FIG. 7). Once the stud 48 is contacted by trigger bar 38 all further forward movement of trigger bar 38 causes rotation of the firing pin blocking piece 43 in a clockwise direction. As firing pin blocking piece 43 further rotates its upstanding finger 42 swings down below firing pin surface 41 to completely unblock firing pin 33. Finally, in the last stages of the forward movement of trigger bar 38 in this double action mode the bar 38 will release projection 67 of hammer 17 (FIGS. 7 and 8) to drop hammer 17 to fire (FIG. 9). In this just fired state, trigger bar 38 is in its up position nested in slide recess 25*b;*

Figures 10, 11:
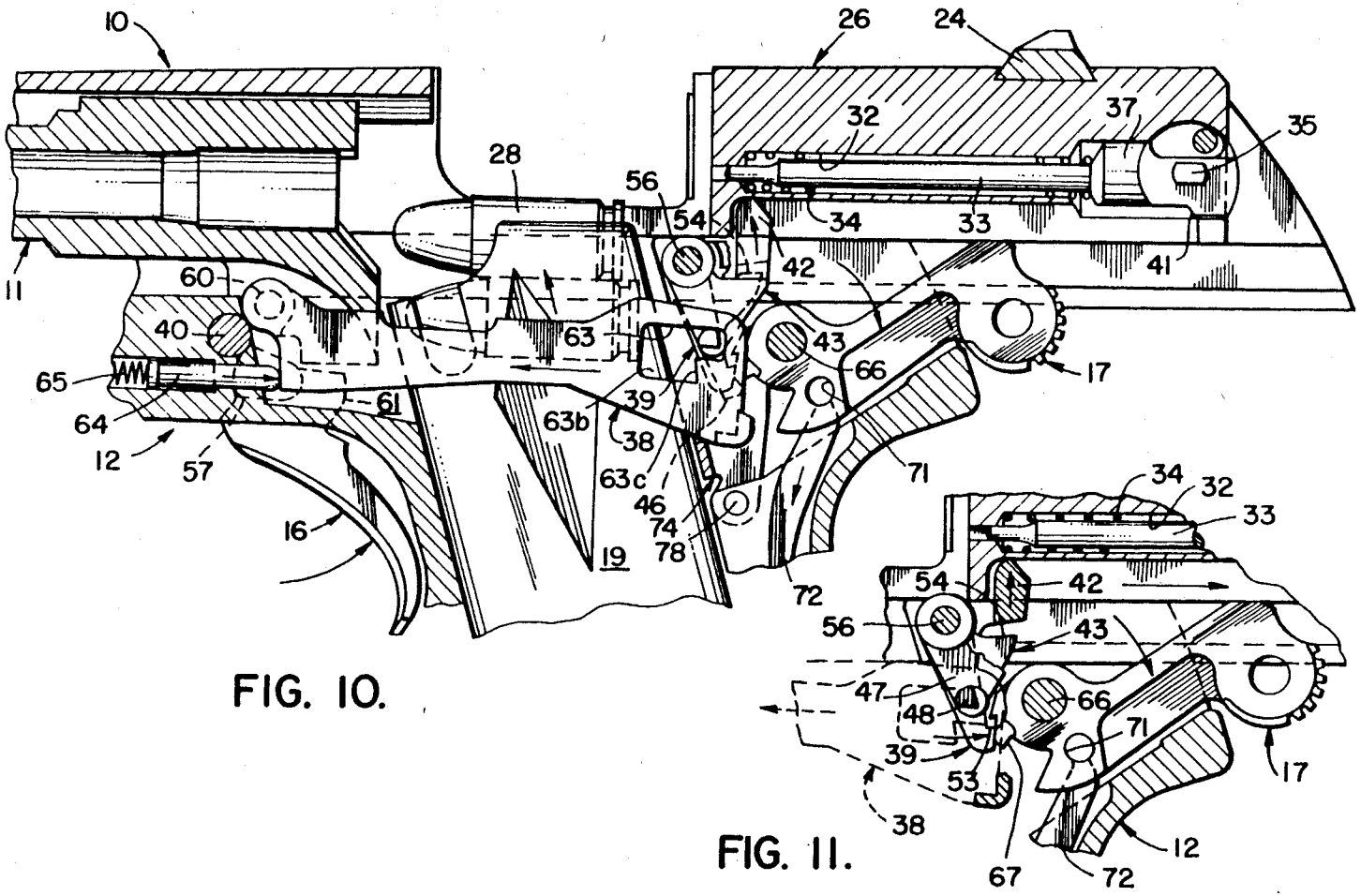
FIG. 10 is a side elevational sectional view showing the slide back with hammer rotated back; trigger bar down and trigger back.
FIG. 11 is a partial enlarged view of FIG. 10.
Figure 13:
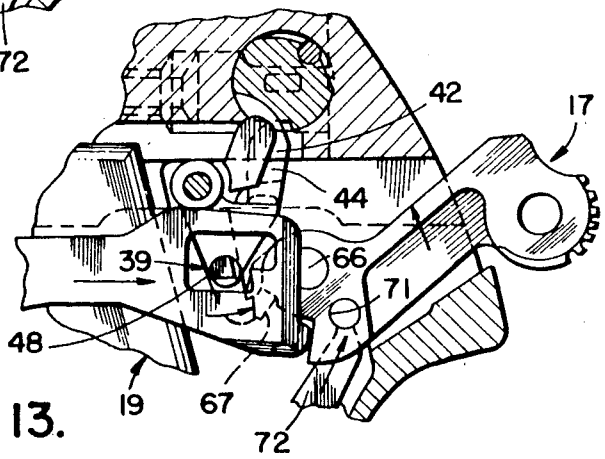
FIG. 13 is a partial enlarged portion of FIG. 12.
Figure 12:
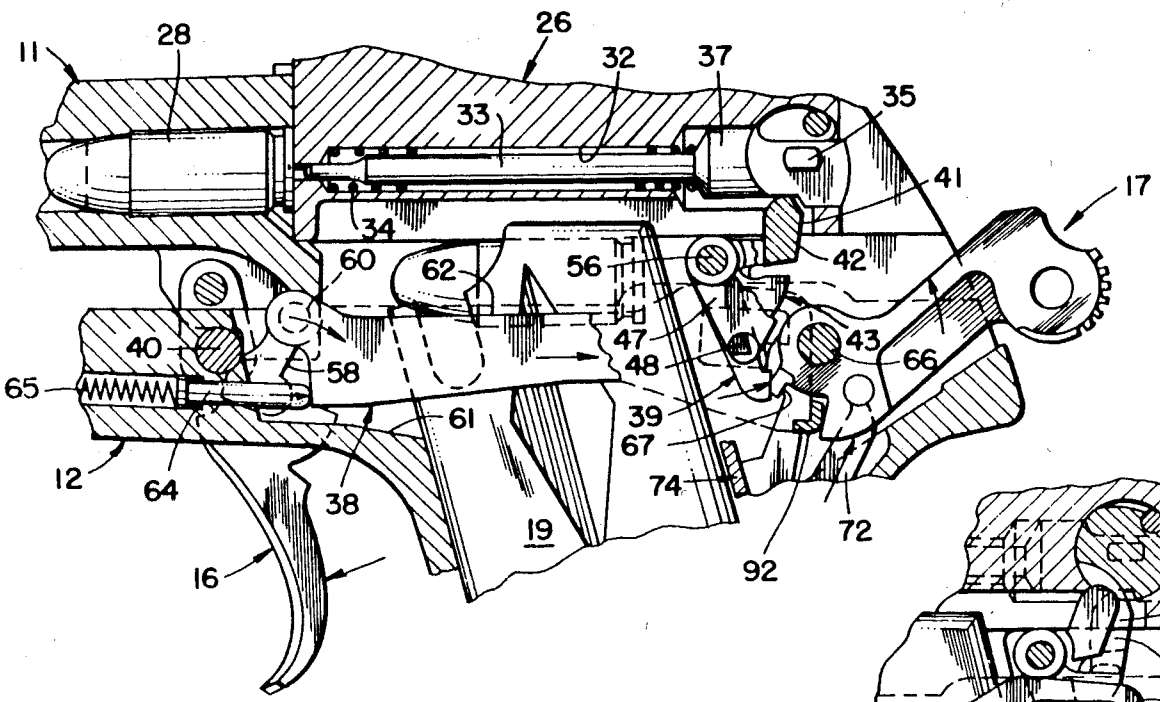
FIG. 12 is a side elevational sectional view of the hammer in cocked position held by the sear after an initial firing and slide return.
Figure 14:
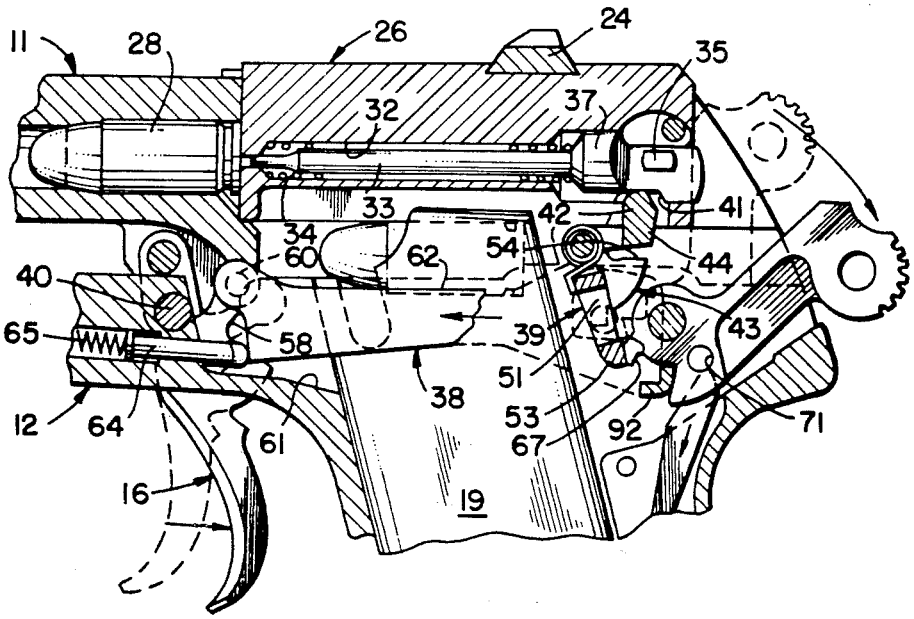
FIG. 14 is a side elevational sectional view in which the hammer and sear is in single action mode.
Figure 15:
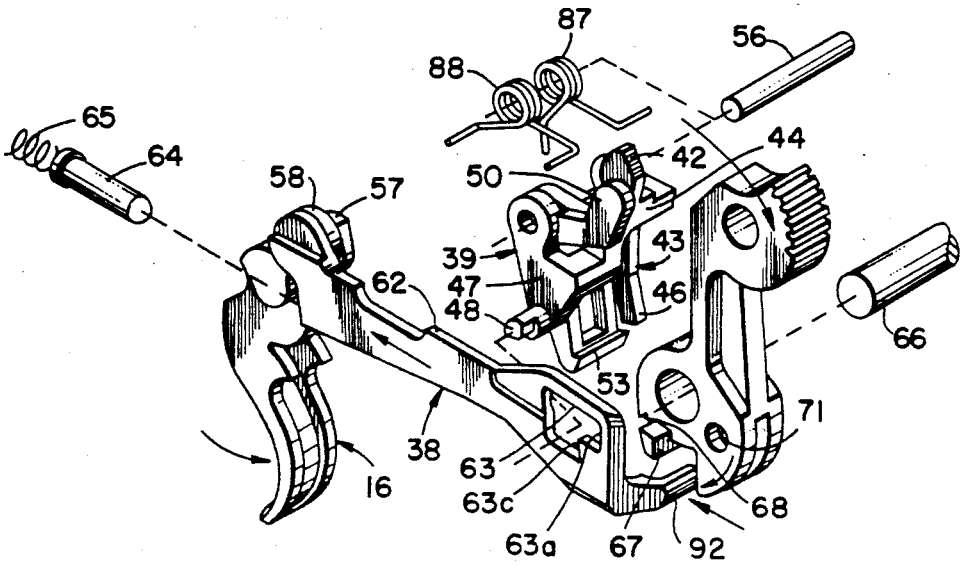
FIG. 15 is an exploded perspective view including the trigger, trigger bar, sear, firing pin blocking piece and hammer.

(c) immediately after firing the pistol slide 26 automatically moves to the rear to cock hammer 17 back and to lower trigger bar 38 as slide interior surfaces 25*a* and 25*b* ride on upper trigger bar surface 62 (FIGS. 10 and 11). With the trigger bar 38 now down, blocking piece stud 48 moves into the upper larger opening portion 63*a* of opening 63 as blocking piece 43 (and its stud 48) rotate to its blocking position (FIGS. 10 and 11). When slide 26 goes forward, hammer 17 rotates a portion of the way down until it engages and remains seated on sear notch 53 (FIG. 12). With slide 26 forward, trigger bar 38 has moved back up into slide surface recess 25*a*. Firing pin blocking piece follower 48 is now in the lower portion 63*b* of opening 63 of bar 38 and ready to be acted upon as when the bar again moves forward. This is the re-set position of the firing mechanism of the pistol;

(d) upon the next trigger pull, trigger arm 38 engages follower stud 48 of firing pin blocking piece 43 to rotate piece 43 which in turn rotates sear 39 by body portion 44 of the blocking piece 43 engaging sear surface 54 (see FIG. 3). Sear 39 continues to rotate with blocking piece 43, until sear notch 53 moves to the point that the hammer 17 is released and a subsequent firing occurs. The blocking piece 43 and sear 39 are preferably configured so that blocking piece 43 rotates a sufficient number of degrees to swing finger 42 just clear of the firing piece 33 before it (piece 43) first contacts the sear 39. Further trigger pull rotates blocking piece finger 42 to assure firing pin 33 clearance by the time sear 39 rotation releases hammer 27 to fire;

(e) in single action mode, hammer 17 is manually cocked back until hammer notch 68 of hammer 17 falls into sear notch 53 (FIG. 14). As described above, subsequent trigger pull causes trigger bar 38 to move, rotating blocking piece 43 (to unblock firing pin 33) and to then rotate sear 39 to release hammer 17 and fire the pistol; and (f) thus after the initial firing (from single or double action modes), the hammer 17 will automatically through reciprocal slide action be placed in a re-set mode (hammer 17 held by sear notch 53).

In the sequence of operations described above, the firing pin blocking piece 43 is in its blocking position at all times except just before firing and during firing. For example, immediately after firing with trigger 16 back, pistol slide 26 moves the trigger bar 38 down as it automatically moves back placing firing pin blocking piece stud 48 in the upper portion 63*a* of opening 63 (FIG. 10). In this trigger bar position, the firing pin blocking piece 43 moves to its normal blocking position. As the slide 26 in its normal cycle again goes forward, the trigger bar 38 will not rotate the blocking piece 43 to unblock the firing pin 33 even if the trigger 16 has held back. With the trigger 16 held back, stud 48 will remain in opening 63*a* as the slide goes forward. Thus, where the trigger is held back during cycling of the slide, firing pin blocking piece 43 will remain in its blocking. To fire the pistol from this trigger back position, the user must first move trigger 16 forward to allow the trigger bar 38 to move under detent spring pressure up against and into recess 25*a* of closed slide 26. The trigger bar 38 being now positioned with the stud 48 in the lower portion 63*b* of the opening 63 is ready to be fired by a subsequent trigger pull.

Figures 16, 17:
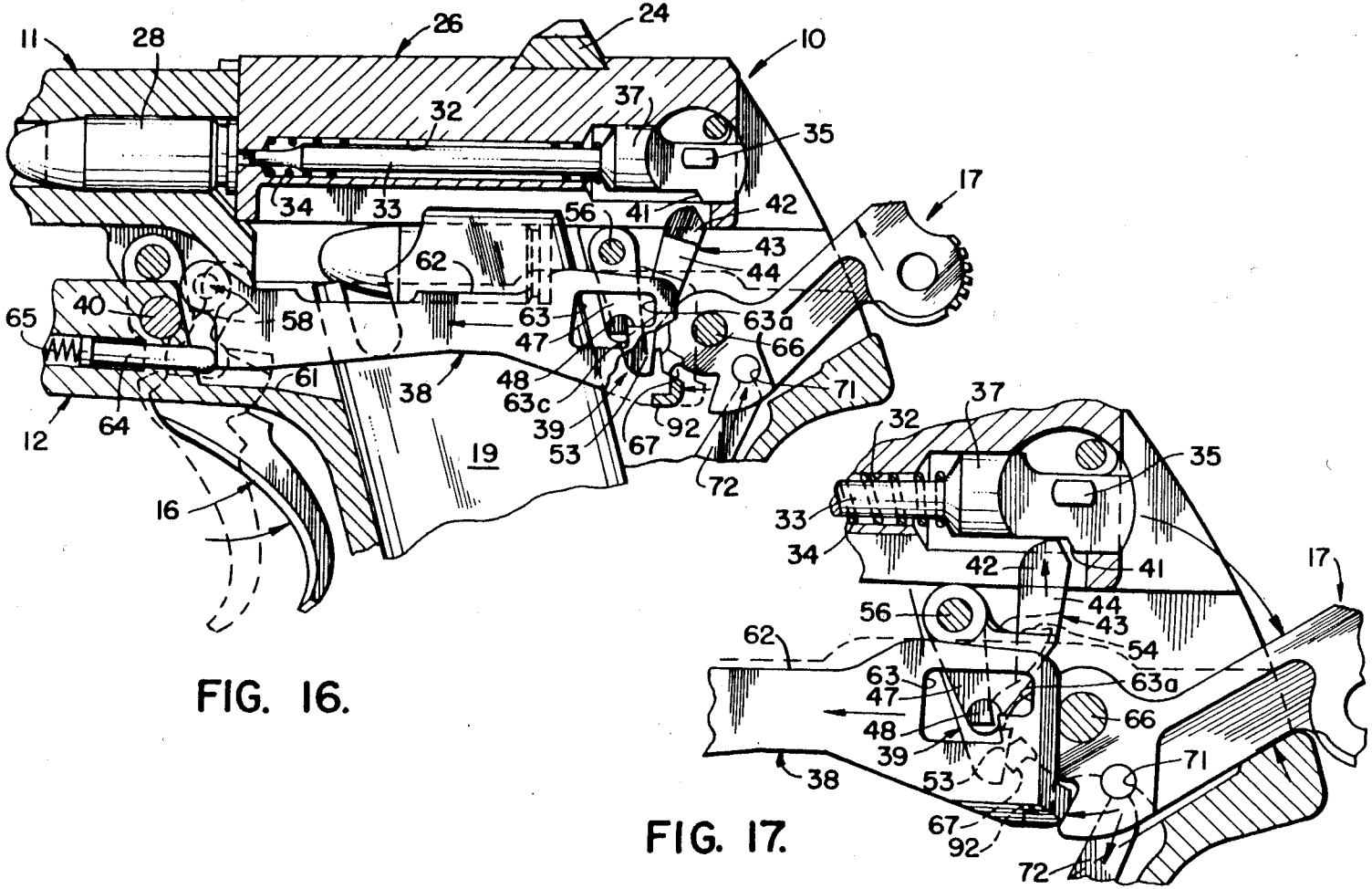
FIG. 16 is a side elevational sectional view showing the hammer being released and firing pin blocking piece rotating as the trigger bar moves forward.
FIG. 17 is an enlarged side elevational sectional view showing the hammer manually cocked against the frame with the firing pin blocking piece in its blocking position.

Turning to FIG. 17, hammer 17 is shown manually pulled back against frame stop surface 95. In this position, the firing pin blocking piece 43 remains in its blocking position with finger projection 42 in front of surface 41 of pin 33. The trigger bar 38, not being connected to hammer 17 and the hammer 17 and bar 38 being configured so as not to engage one another in this hammer position, trigger bar 38 remains stationary. Since only trigger bar movement can lead to the unblocking of firing pin, firing pin 33 remains blocked. If hammer 17 is released in this fully back position, hammer 17 will move forward under the force of strut 72 until the hammer notch 68 engages the sear notch 53.

Upon expenditure of all rounds in magazine 19, a new magazine is loaded and the initial firing can, as described above, be first by single or double action. Thereafter sequential semi-automatic firing may proceed from the reset position.

Figure 18:
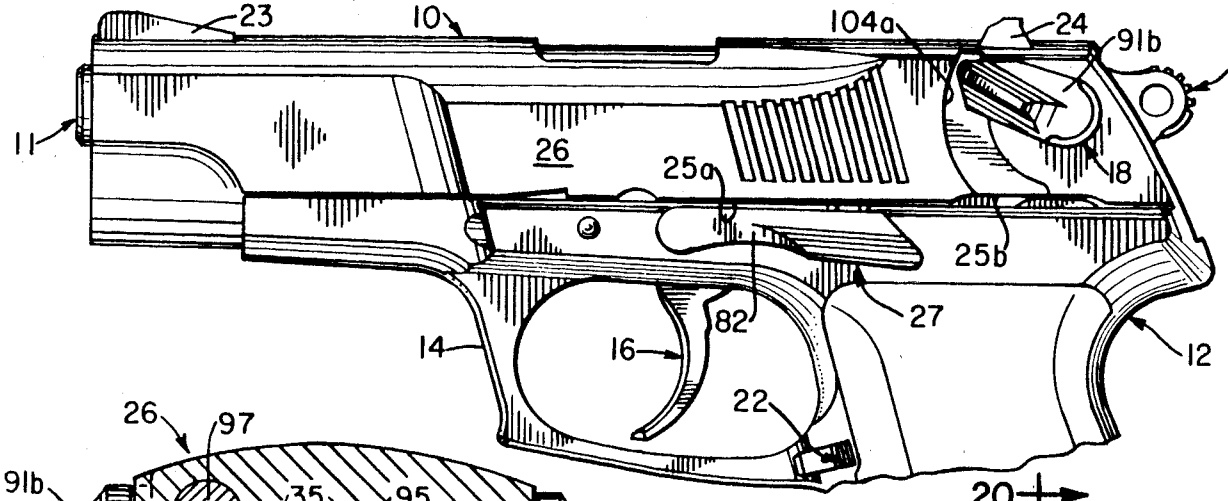
FIG. 18 is a partial left side elevational view of a pistol including the manual safety lever.
Figure 19:
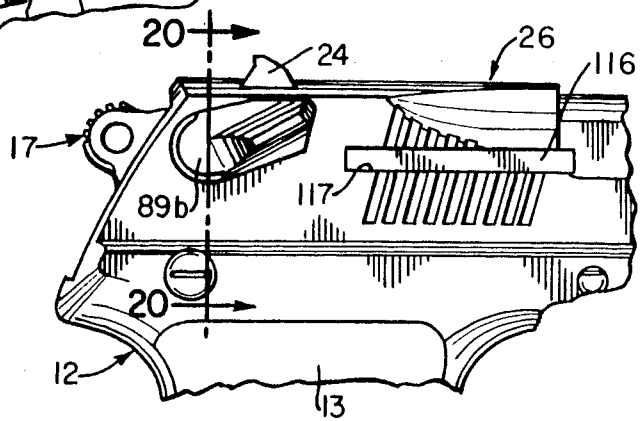
FIG. 19 is a partial right side elevational view of the pistol.
Figure 20:
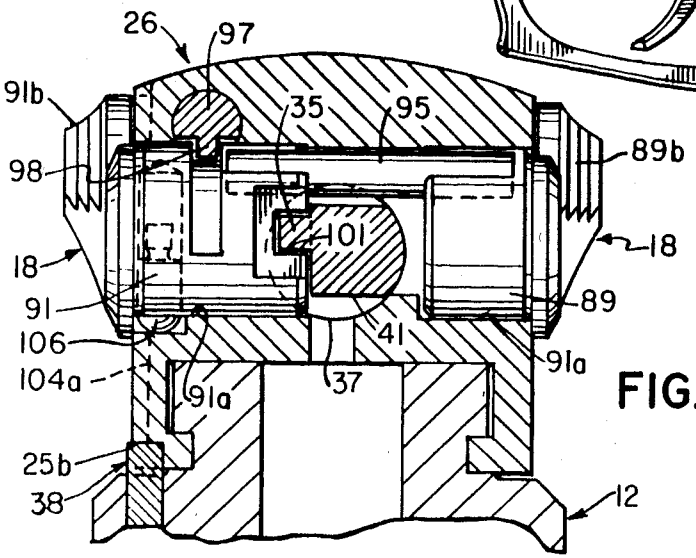
FIG. 20 is a sectional view taken along line 20—20 of FIG. 19.

The manual safety arrangement and alternative safety mechanism embodiments are shown in FIGS. 18 through 36. With particular reference to FIGS. 18–20, pistol 10 includes frame 12, slide 26, barrel 11, trigger 16, trigger guard 14, handle grip 13 and slide 26 and safety mechanism 18.

Figure 33:
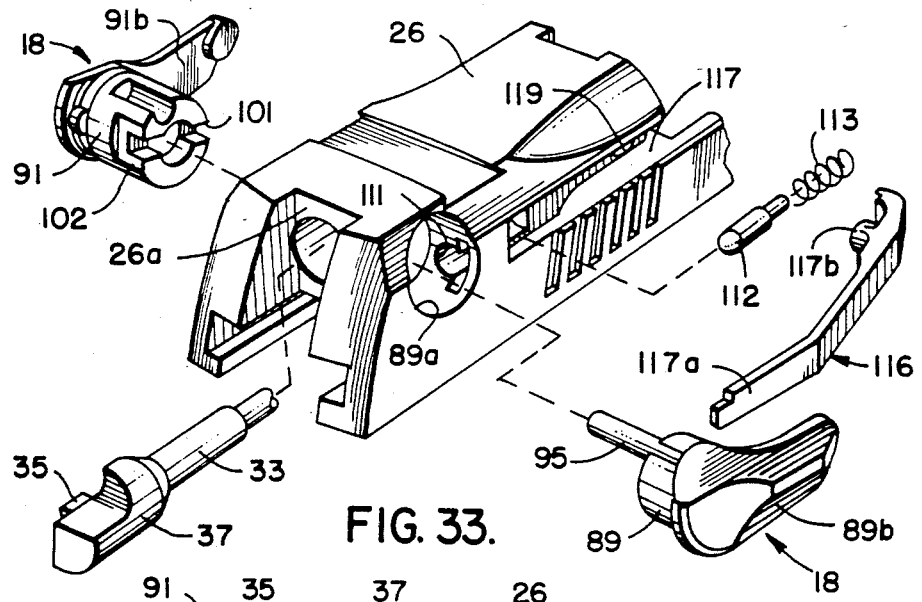
FIG. 33 is a perspective view of the rear end of the slide and firing pin, the mechanism sections, connector piece, and detent means for holding the safety mechanism in the slide.
Figure 34:
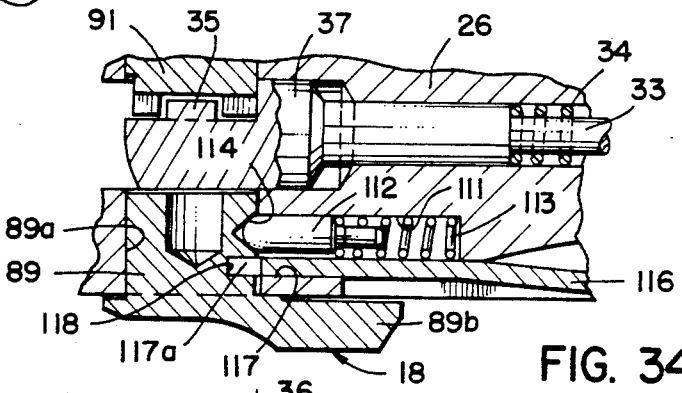
FIG. 34 is a partial sectional view showing the detent assembly arrangement.
Figure 35:
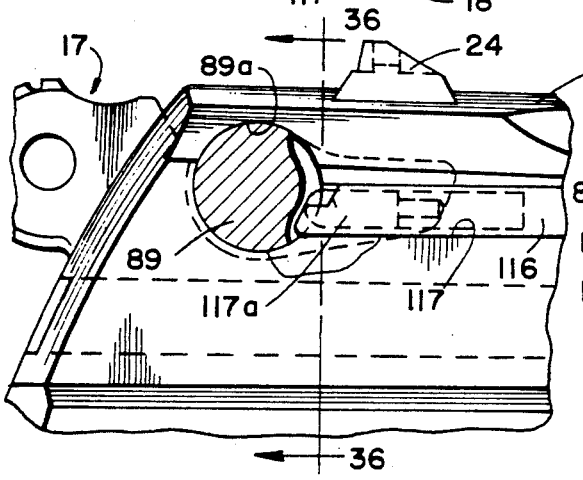
FIG. 35 is a partial elevational sectional view showing the spring piece positioned in the right mechanism section.
Figure 36:
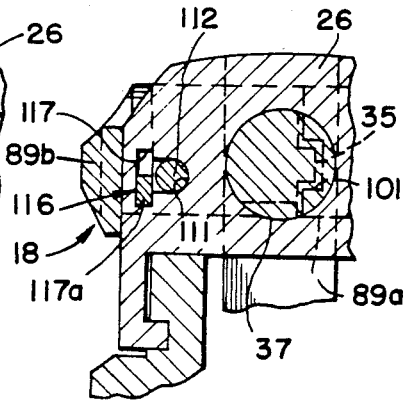
FIG. 36 is another partial elevational sectional view showing the detent and spring piece in cross-section.

Turning in particular to FIGS. 20, 28 and 33, it is seen that manual safety lever mechanism 18 includes right and left body sections 89, 91 mounted for rotation in round slide openings 89*a* and 91*a*, respectively. Sections 89, 91 straddle firing pin 33 and are joined together by connecting pin 95 so that when one section is rotated in its slide opening the other section also rotates. This arrangement permits ambidextrous operation of the safety lever mechanism 18 by operation of right and left thumbpieces 91*b* and 89*b*.

Left section 91 is held in position in slide opening 91*a* by retaining pin 97 mounted in slide 26 which pin 97 has a longitudinal projection key 98 projecting down into slot 99 (FIGS. 20, 28). Connecting pin 95 is secured to the left-hand section 91 by welding or brazing; passes through firing pin opening 33*a* and has its other end connected to the right safety section 89.

Figure 21:
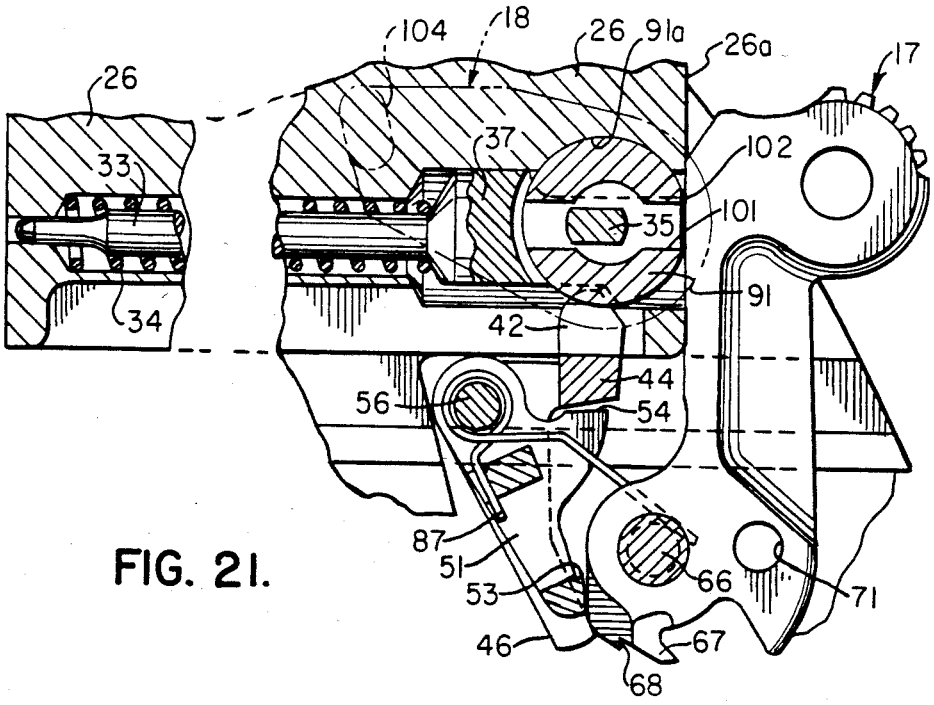
FIG. 21 is an enlarged partial sectional view showing the safety mechanism in its first or "off" position with the hammer down.
Figure 22:
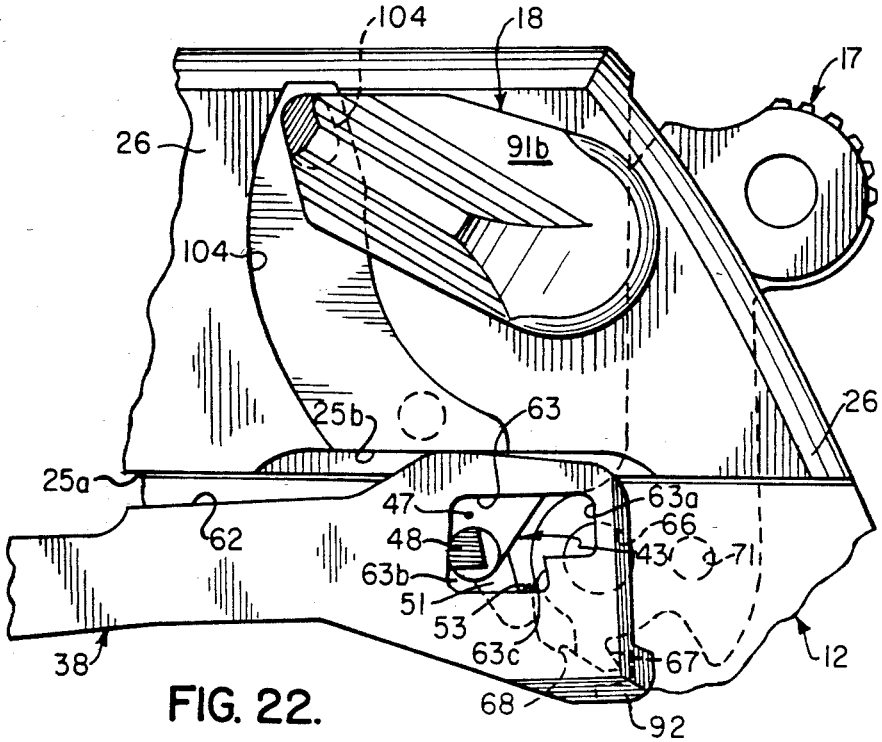
FIG. 22 is an enlarged partial sectional view showing the safety mechanism in the "off" position with the trigger bar back and up.

Turning to FIGS. 21–22, 28 and 33, it is seen that with the manual safety lever 18 in the "off" position the firing pin 33 is not blocked since firing pin side projection 35 is free to pass through projection opening 101 of left section 91. Left section 91 includes a flat hammer bearing surface 102 against which hammer 17 rests in its down position (FIGS. 21, 28). In the hammer-down position, hammer 17 is urged toward the rear slide surface 26*a* (FIG. 33) with sufficient force to move firing pin 33 forward somewhat overcoming the resistance of firing pin spring 34. In the "off" mode of safety lever mechanism 18, it performs none of its safety functions; however, the firing pin blocking finger 42 of firing pin blocking piece 43 automatically blocks firing pin 33 from moving fully forward in the hammer-down position as described supra.

Figure 23:
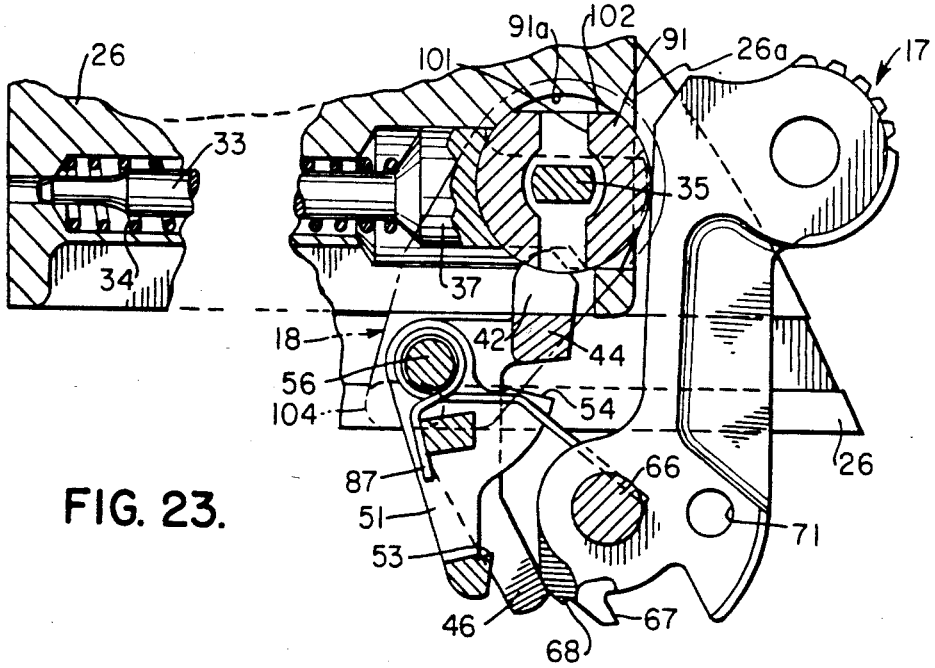
FIG. 23 is an enlarged partial sectional view showing the safety mechanism in its second or "on" position with the hammer cammed off the firing pin; with the sear rotated away from the hammer; and firing pin side projection confined.
Figure 24:
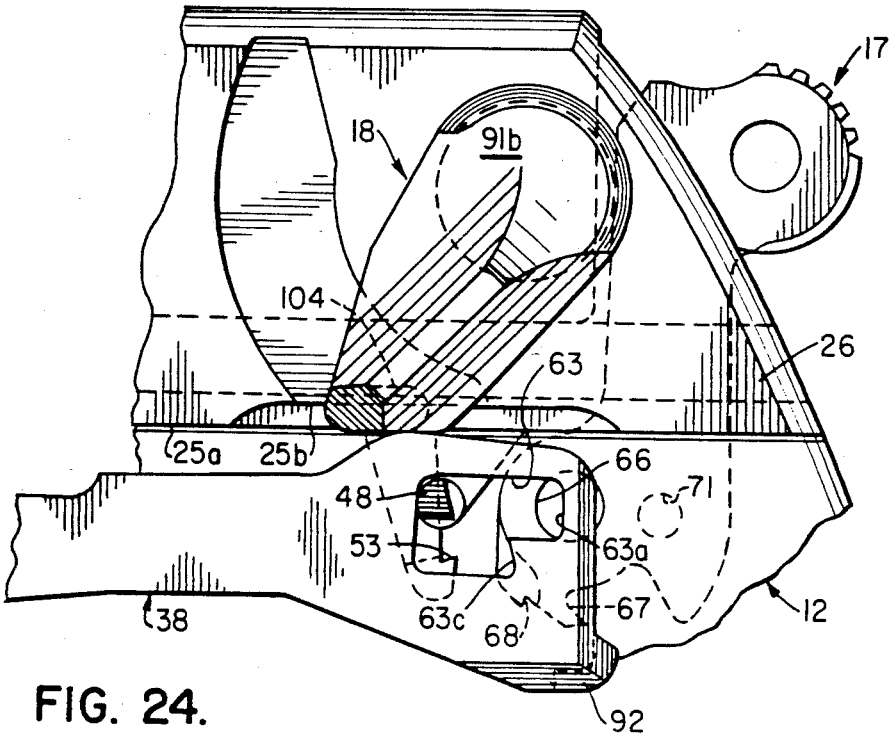
FIG. 24 is an enlarged partial sectional view similar to FIG. 23 with the trigger bar held down.
Figure 25:
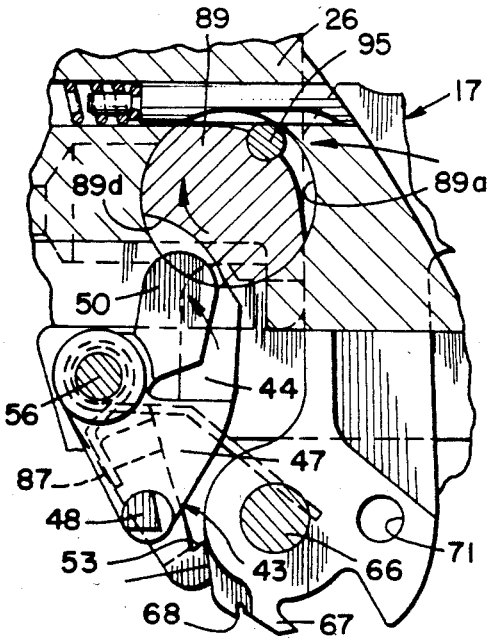
FIG. 25 is a partial sectional view showing safety section clearance cut for the sear cam.
Figure 26:
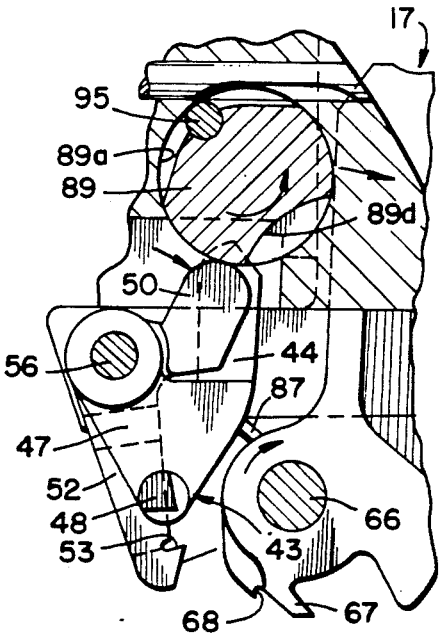
FIG. 26 is a partial sectional view showing the safety section rotated to engage the sear cam and rotate the sear away from the hammer.

Turning to FIGS. 23, 24, 25, 26 and 28, the manual safety mechanism 18 is seen in its second position (its "on" and operative position). In this mode the following conditions are met:

(a) the rotation of left section 91 causes flat hammer bearing surface 102 of section 91 to rotate, in turn, causing hammer 17 to rotate clockwise about hammer pivot 66 a distance such that the firing pin 33 cannot be struck by the hammer 17 if struck a blow or if further cocked and released (see FIG. 23);

(b) left hand thumbpiece 91*b* includes an interior thumbpiece lug 104 accommodated in its recess 104*a* which lug 104 moves into a position adjacent slide recess 25*b* and functions to prevent the trigger bar 38 from rising above the slide straight line surface 25*a* of slide 26 thus preventing rotation of the firing pin block 43 when trigger 16 moves trigger bar 38 forward as explained and described supra; and (c) right safety section 89 includes slot 89*d* which accommodates sear manual latch (safety) projection 50 in certain positions of section 89. When section 89 is rotated a sufficient distance clockwise (as shown in FIGS. 25 and 26), projection 50 is moved to pivot sear 39 to a position where the hammer 17 cannot engage the sear 39 (see again FIGS. 25, 26).

Figure 27:
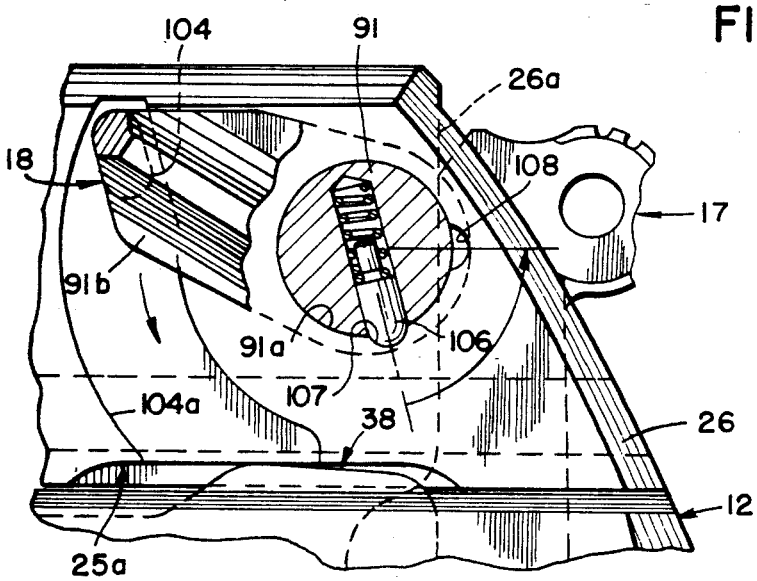
FIG. 27 is a partial sectional view showing the detent arrangement for the two position safety mechanisms.

With attention to FIGS. 27 and 28, a spring loaded detent 106 is positioned in left section 91 for entry into slide detent recess 107 in the safety's first "off" position and in slide detent recess 108 in the safety's second "on" position.

Figure 29:
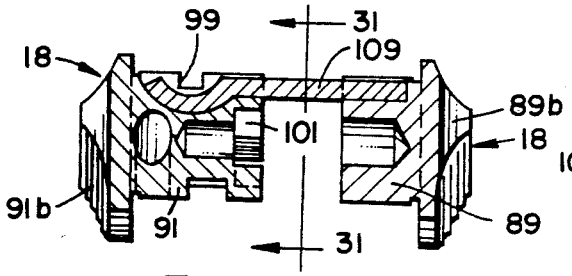
FIG. 29 is a sectional view showing an alternative embodiment for connecting the safety mechanism sections.

FIG. 29 shows an alternative embodiment of the safety mechanism 18 in which the sections 89, 91 are connected with a square wire key 109. Key 109 is snapped into left section 91 and secured to right section 89.

Figure 30:
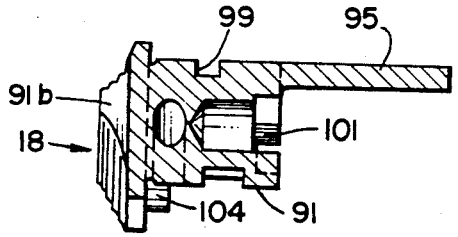
FIG. 30 is a sectional view along line 30—30 of FIG. 31 showing an alternative embodiment in which the left section includes the connecting pin.

FIG. 30 depicts the left-hand section 91 in section showing connector pin 95, slot 102, thumbpiece 91*b* and firing pin lateral projection slot 101.

Figure 31:
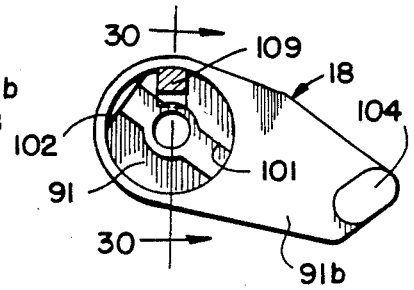
FIG. 31 is an end view of the FIG. 29 embodiment.

FIG. 31 shows an alternative embodiment of left section 91 including thumbpiece 91*b*, key 109 and thumbpiece lug 104.

Figure 32:
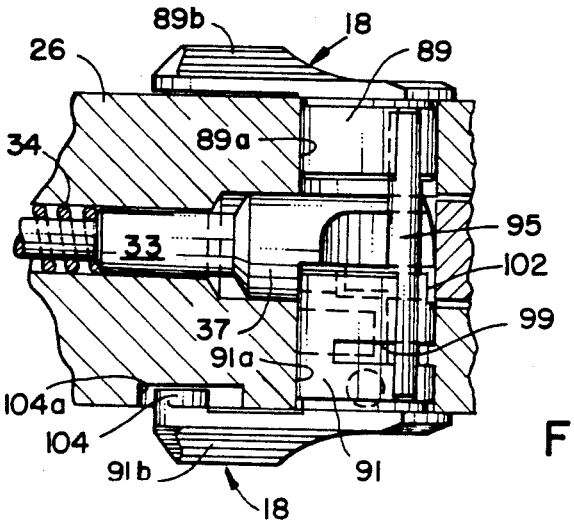
FIG. 32 is a sectional view showing a first embodiment of the safety of FIG. 18.

FIG. 32 shows a section of the first embodiment of the safety (see also FIG. 18) including connecting pin 95, firing pin 33, safety lever sections 89, 91 and thumbpieces 89*b*, 91*b*, slot 102 and left thumbpiece lug 104.

Turning finally to FIGS. 33–36, a readily disassembly arrangement for section 89 in slide opening 89*a* is shown. A right section detent recess 111 in slide 26 carries detent 112 urged by its spring 113 into right section first depression 114. Detent 112 is held in place by removable spring piece 116 positioned in slide slot 117. Spring piece 116 when assembled into slide slot 117 has its rearward end 117*a* inserted into right section second depression 118. After spring piece end 117*a* is inserted into second depression 118, spring piece 116 is flexed so that its protrusion 117*b* can be engaged in slide slot recess 119.

We claim:

1. In a semi-automatic pistol having a reciprocating slide with a firing pin therein, a trigger, a trigger bar, a sear, and a hammer, the improvement comprising (A) a pivotal firing pin blocking means mounted on the pistol frame, the blocking means having
  (i) an upper finger means for blocking the firing pin;
  (ii) a lower trigger-bar-engageable projection lug positioned in and at times engageable with the trigger bar;

(B) a trigger bar having a forward end portion and a rearward end portion;
  (i) the forward end portion pivotal about the trigger;
  (ii) the rearward end portion having
    (a) a configured opening therein for receiving said blocking means projection lug;
    (b) a hammer engageable extension; and
    (c) an upper surface engageable with a surface on the slide;

(C) a sear mounted adjacent the blocking means and engageable with the hammer when the hammer is lowered; such sear caused to rotate by rotation of the blocking means;

(D) a configured surface on the slide in engagement with the upper surface of the trigger bar to permit the rearward end portion of trigger bar to (i) raise when the slide is forward and (ii) to lower when the slide is rearward;

a manual safety lever arrangement comprising (a) slide bearing openings in such slide adjacent the firing pin;

(b) a safety lever body portion rotatably mounted in the slide bearing openings straddling the firing pin, said body portion including a right-hand body section projecting from the right-hand of the slide and a left-hand body portion projecting from the left-hand side of the slide; said body portion being rotatable to a first position and to a second position;

(c) first hammer means on one of the body sections for permitting the hammer to engage the firing pin in the first position;

(d) second hammer means on one of the body sections for preventing the hammer from engaging the firing pin when the lever is in the second position;

(e) firing pin blocking means on one of the sections for blocking the firing pin in the second position;

(f) sear engaging means on one of the body sections for rotating the sear so it cannot engage the hammer in such section safety lever position; and (g) trigger bar engaging means for engaging the trigger bar to prevent the bar, in its forward movement, from rotating the firing pin blocking means to unblock the firing pin.

2. The manual safety lever arrangement of claim 1 in which one body portion is held in the slide by detent means positioned in a recess in the slide and in a depression in such body portion.

3. The manual safety lever arrangement of claim 1 in which a flexible readily removable bar means is positioned in a recess in the slide and in a depression in the body portion.

* * * * *